US009296578B2

(12) United States Patent
Ohta

(10) Patent No.: US 9,296,578 B2
(45) Date of Patent: Mar. 29, 2016

(54) SHEET EJECTOR AND SHEET FEEDER HAVING THE SAME

(71) Applicant: Masahiko Ohta, Aichi (JP)

(72) Inventor: Masahiko Ohta, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/168,193

(22) Filed: Jan. 30, 2014

(65) Prior Publication Data

US 2014/0210156 A1 Jul. 31, 2014

(30) Foreign Application Priority Data

Jan. 31, 2013 (JP) ..... 2013-016349

(51) Int. Cl.
*B65H 31/00* (2006.01)
*B65H 5/06* (2006.01)
(Continued)

(52) U.S. Cl.
CPC ..... *B65H 5/062* (2013.01); *B65H 1/04* (2013.01); *B65H 3/063* (2013.01); *B65H 3/5238* (2013.01); *B65H 29/125* (2013.01); *B65H 29/14* (2013.01); *B65H 29/52* (2013.01); *G03G 15/6552* (2013.01); *B65H 2301/42122* (2013.01); *B65H 2402/441* (2013.01); *B65H 2404/1115* (2013.01); *B65H 2404/1317* (2013.01); *B65H 2404/1521* (2013.01); *B65H 2405/115* (2013.01); *B65H 2405/3322* (2013.01);
(Continued)

(58) Field of Classification Search
CPC .... B65H 2801/06; B65H 31/02; B65H 5/062; B65H 29/12; B65H 2601/11; B65H 29/22; B65H 27/00; B65H 29/70; B65H 2301/42122; B65H 5/38; G06K 13/12; B41J 13/103; B41F 21/05; G03G 15/60
USPC ..... 271/207, 272, 273, 274, 314, 188, 209, 271/212, 4.01, 4.1, 264
See application file for complete search history.

(56) References Cited

U.S. PATENT DOCUMENTS 7,342,693 B2 * 3/2008 Morisaki ..... 358/496
7,380,787 B2 * 6/2008 Fukumura ..... 271/264
(Continued)

FOREIGN PATENT DOCUMENTS

CN 1854044 A 11/2006
CN 101844706 A 9/2010
(Continued)

OTHER PUBLICATIONS

Office Action issued in related Chinese application No. 201410047143.8, mailed Oct. 8, 2015.

*Primary Examiner* — Thomas Morrison
(74) *Attorney, Agent, or Firm* — Merchant & Gould P.C.

(57) ABSTRACT

A sheet ejector is provided that includes an ejection roller unit including a first roller and a second roller, a pushing member that rotates concentrically with the first roller and includes a projection formed on a circumferential surface thereof, the projection contacting a trailing end of a sheet to be ejected and pushing out the sheet in an ejecting direction, and a contact member including a contact portion disposed, in a view along a rotational-axis direction of the first roller, in such a position as to overlap or be downstream relative to a most downstream position of a rotational trajectory of the pushing member in the ejecting direction, the contact portion configured to extend up to a position closer to the second roller than the rotational axis of the first roller and contact the trailing end of the sheet ejected from the ejection roller unit.

7 Claims, 7 Drawing Sheets

(51) Int. Cl.

| | |
|---|---|
| ***B65H 29/12*** | (2006.01) |
| ***B65H 29/14*** | (2006.01) |
| ***B65H 29/52*** | (2006.01) |
| ***G03G 15/00*** | (2006.01) |
| ***B65H 1/04*** | (2006.01) |
| ***B65H 3/06*** | (2006.01) |
| ***B65H 3/52*** | (2006.01) |

(52) U.S. Cl.
CPC ..... *B65H2601/521* (2013.01); *B65H 2801/06* (2013.01); *B65H 2801/39* (2013.01)

(56) References Cited

U.S. PATENT DOCUMENTS

| | | | | |
|---|---|---|---|---|
| 8,561,986 | B2 * | 10/2013 | Kozaki et al. | 271/274 |
| 2007/0018375 | A1 | 1/2007 | Tanaka et al. | |
| 2007/0210512 | A1 * | 9/2007 | Sakakibara et al. | 271/314 |
| 2010/0244357 | A1 | 9/2010 | Takahata | |
| 2010/0295233 | A1 * | 11/2010 | Kano | 271/3.14 |
| 2012/0248681 | A1 * | 10/2012 | Kozaki et al. | 271/109 |

FOREIGN PATENT DOCUMENTS

| | | | |
|---|---|---|---|
| JP | 1-110470 | A | 4/1989 |
| JP | 4-32456 | * | 2/1992 |
| JP | 9-40256 | A | 2/1997 |
| JP | 2000-53300 | A | 2/2000 |
| JP | 2007-31045 | A | 2/2007 |
| JP | 2007-197163 | A | 8/2007 |
| JP | 2007-238252 | A | 9/2007 |
| JP | 2011-105468 | * | 6/2011 |
| JP | 2012-236707 | A | 12/2012 |

* cited by examiner

SHEET EJECTOR AND SHEET FEEDER HAVING THE SAME

CROSS-REFERENCE TO RELATED APPLICATION

This application claims priority under 35 U.S.C. §119 from Japanese Patent Application No. 2013-016349 filed on Jan. 31, 2013. The entire subject matter of the application is incorporated herein by reference.

BACKGROUND

1. Technical Field

The following description relates to one or more techniques for a sheet ejector configured to eject a sheet onto a catch tray.

2. Related Art

An automatic document feeder (hereinafter, which may be referred to as an ADF) used for a copy machine or a multifunction peripheral (hereinafter, which may be referred to as an MFP) includes an ejection roller unit configured to eject onto a catch tray a sheet (such as a document sheet) fed to the ejection roller unit. For instance, a configuration has been known in which a driven roller of the ejection roller unit includes projections formed to radially protrude from a circumferential surface of the driven roller at both ends in an axial direction of the driven roller. Further, the projections are configured to, in response to rotation of the driven roller, turn in a rotational direction and contact a trailing end of a sheet to be ejected, so as to push out the sheet in an ejecting direction.

SUMMARY

In the known configuration, when there is not an enough space secured between the trailing end of the ejected sheet and the driven roller, the turning projections might sequentially come into contact with the trailing end of the ejected sheet, and it might cause undesired noises.

Aspects of the present invention are advantageous to provide one or more improved techniques, for a sheet ejector, which make it possible to prevent generation of undesired noises due to sequential contacts between a trailing end of an ejected sheet and projections formed on a driven roller of an ejection roller unit.

According to aspects of the present invention, a sheet ejector is provided, which includes an ejection roller unit including a first roller and a second roller, the ejection roller unit configured to eject a sheet onto a catch tray, a pushing member configured to rotate concentrically with the first roller, the pushing member including a projection formed on a circumferential surface of the pushing member, the projection configured to contact a trailing end of the sheet to be ejected, and to push out the sheet in an ejecting direction, and a contact member including a contact portion disposed, in a view along a rotational-axis direction parallel to a rotational axis of the first roller, in one of such a position as to overlap a most downstream position of a rotational trajectory of the pushing member in the ejecting direction, and a position downstream relative to the most downstream position of the rotational trajectory of the pushing member in the ejecting direction, the contact portion configured to extend up to a position closer to the second roller than the rotational axis of the first roller and contact the trailing end of the sheet ejected from the ejection roller unit.

According to aspects of the present invention, further provided is a sheet feeder including a feed tray, a catch tray, and a sheet feeding unit configured to feed a sheet from the feed tray toward the catch tray along a conveyance path, the sheet feeding unit including a pickup roller configured to feed the sheet placed on the feed tray onto the conveyance path, a separation unit configured to feed the sheet fed from the pickup roller, in a manner separated on a sheet-by-sheet basis, one or more feed rollers configured to convey the sheet fed from the separation unit, toward the catch tray along the conveyance path, an ejection roller unit including a first roller and a second roller, the ejection roller unit configured to eject, onto the catch tray, the sheet conveyed by the one or more feed rollers, and a pushing member configured to rotate concentrically with the first roller, the pushing member including a projection formed on a circumferential surface of the pushing member, the projection configured to contact a trailing end of the sheet to be ejected, and to push out the sheet in an ejecting direction, and a contact member including a contact portion disposed, in a view along a rotational-axis direction parallel to a rotational axis of the first roller, in one of such a position as to overlap a most downstream position of a rotational trajectory of the pushing member in the ejecting direction, and a position downstream relative to the most downstream position of the rotational trajectory of the pushing member in the ejecting direction, the contact portion configured to extend up to a position closer to the second roller than the rotational axis of the first roller and contact the trailing end of the sheet ejected from the ejection roller unit.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompanying drawings. It is noted that, in the following descriptions, a front side, a rear side, a left side, a right side, an upside, and a downside will be defined as shown in the accompanying drawings. Further, in the following descriptions, a direction (indicated by a void arrow in FIG. 1) to eject a document sheet M onto a below-mentioned catch tray 20 from a below-mentioned document feeding unit 30 will be referred to as an "ejecting direction."

<General Configuration of ADF>

Figure 1:
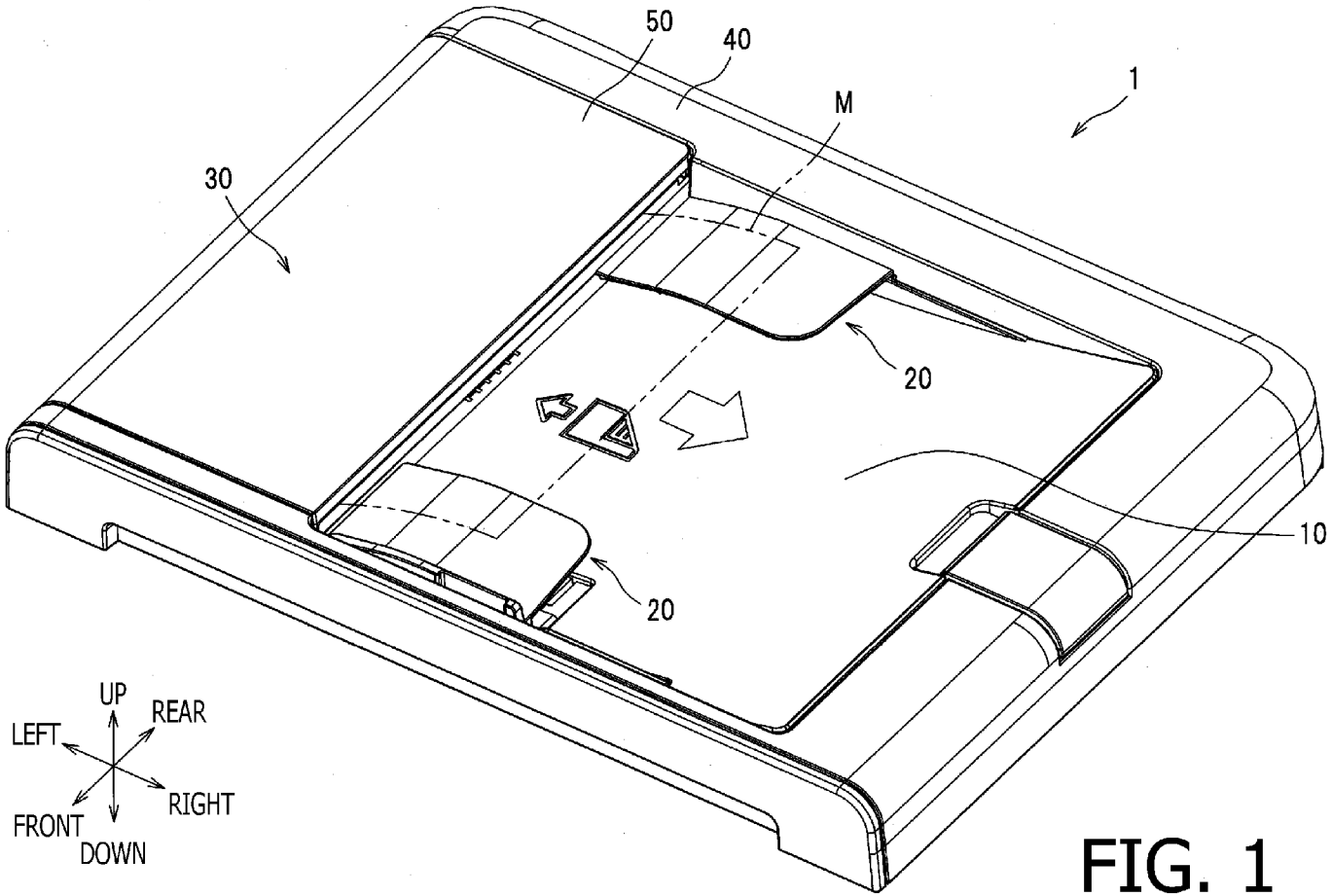
FIG. 1 is a perspective view showing an automatic document feeder (hereinafter which may be referred to as an ADF) in an embodiment according to one or more aspects of the present invention.

Initially, an explanation will be provided about a general configuration of an automatic document feeder (hereinafter which may be referred to as ADF) 1 in the embodiment. The ADF 1 shown in FIG. 1 is disposed above a known flatbed scanner (not shown) and configured to be openable and closable relative to a document table of the flatbed scanner. The ADF 1 includes a feed tray 10, a catch tray 20, and a document feeding unit 30. The feed tray 10 is configured to support a document sheet M set thereon. The catch tray 20 is disposed above the feed tray 10 and configured to receive the document sheet M ejected thereon. The document feeding unit 30 is configured to feed the document sheet M from the feed tray 10 toward the catch tray 20.

Figure 2:
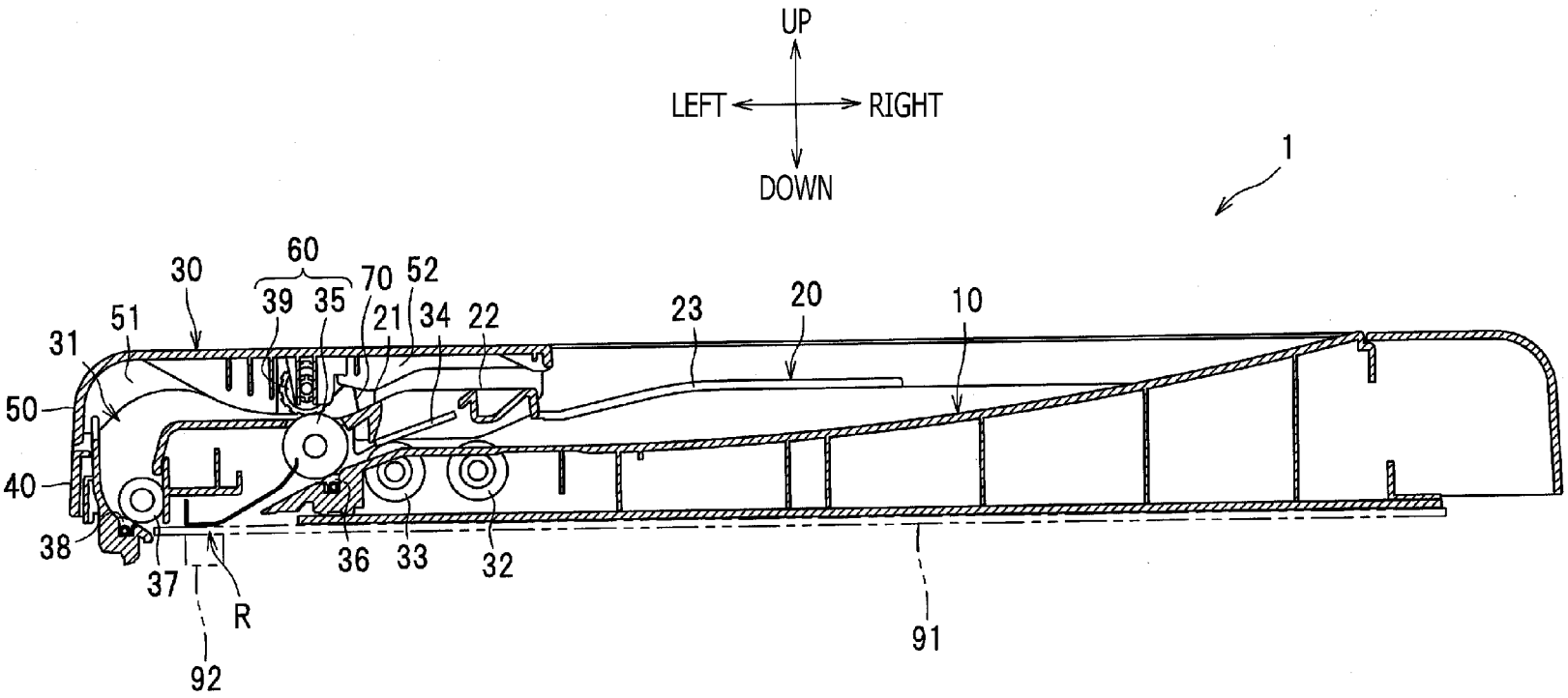
FIG. 2 is a cross-sectional view schematically showing an internal configuration of the ADF in the embodiment according to one or more aspects of the present invention.

As shown in FIG. 2, the document feeding unit 30 includes a conveyance path 31 that is formed substantially in a U-shape and configured to guide the document sheet M set on the feed tray 10 toward the catch tray 20. Along the conveyance path 31, disposed are a pickup roller 32, a separation roller 33, a separation nipping member 34, a first feed roller 35, a first pinch roller 36, a second feed roller 37, a second pinch roller 38, and an ejection pinch roller 39. In the embodiment, the ejection pinch roller 39 and the first feed roller 35 constitute an ejection roller unit 60.

A reading position R is between the first feed roller 35 and the second feed roller 37 on the conveyance path 31. The reading position R is located to face an image sensor 92 across a platen glass 91 that is a document table of the flatbed scanner. The image sensor 92 is configured to read out, in the reading position R, an image formed on the document sheet M being conveyed toward the catch tray 20 along the conveyance path 31.

Document sheets set on the feed tray 10 are fed into the document feeding unit 30 by the pickup roller 32. After separated on a sheet-by-sheet basis between the separation roller 33 and the separation nipping member 34, the document sheets are sequentially conveyed toward the first feed roller 35. Then, the document sheets are sequentially conveyed toward the reading position R while being pinched between the first feed roller 35 and the first pinch roller 36. Afterward, the document sheets are sequentially read by the image sensor 92 while passing through the reading position R, and then conveyed toward the catch tray 20 while being pinched between the second feed roller 37 and the second pinch roller 38. Thereafter, the document sheets are sequentially ejected out of the document feeding unit 30 by the ejection roller unit(s) 60, and put onto the catch tray 20.

<Detailed Configuration of ADF>

Hereinafter, a detailed configuration of the ADF 1 will be described. The ADF 1 includes a frame 40 made of resin, a cover 50 made of resin, the ejection roller units 60 configured to eject the document sheet M toward the catch tray 20, and lifting members 70.

The frame 40 is configured to form the feed tray 10, the catch tray 20, and a lower portion of a housing of the document feeding unit 30. Further, the frame 40 is configured to rotatably support the pickup roller 32, the separation roller 33, the first feed roller 35, the first pinch roller 36, the second feed roller 37, and the second pinch roller 38.

Figure 3:
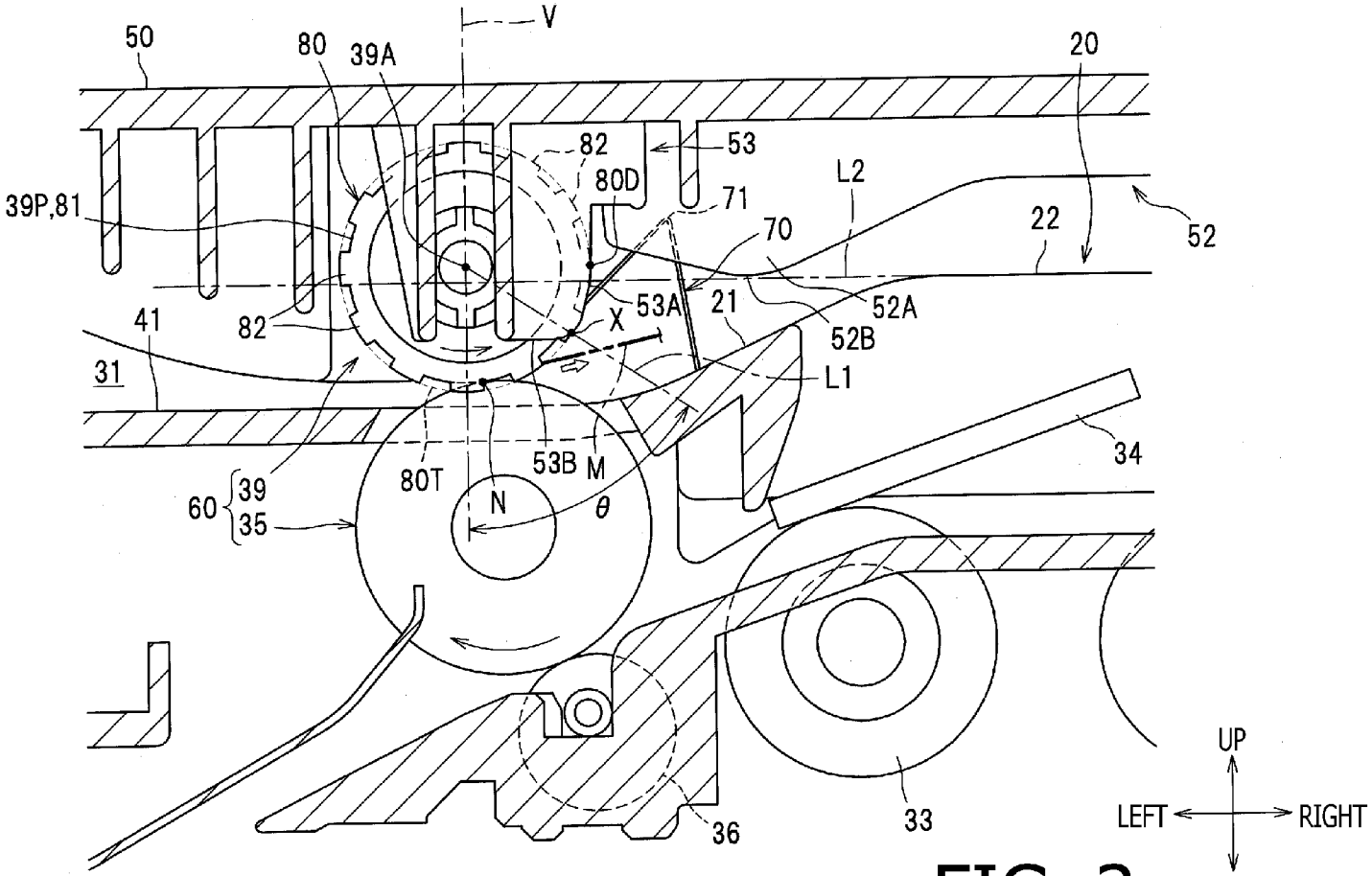
FIG. 3 is an enlarged view schematically showing a configuration around an ejection roller unit (i.e., an ejection pinch roller and a first feed roller) in the ADF in the embodiment according to one or more aspects of the present invention.

The catch tray 20 includes a slanted portion 21, an inner loading portion 22, and an outer loading portion 23. As shown in FIG. 3, the slanted portion 21 is formed to extend obliquely in an upper right direction from a lower right side of a nipping position N between the first feed roller 35 and the ejection pinch roller 39 when viewed along a rotational-axis direction (which is a direction in which a rotational axis 39A extends, and corresponds to a front-to-rear direction) of the ejection pinch roller 39. Further, the inner loading portion 22 is formed to extend substantially horizontally along the ejecting direction from a downstream end of the slanted portion 21 in the ejecting direction when viewed along the rotational-axis direction of the ejection pinch roller 39. Referring back to FIG. 2, the outer loading portion 23 is formed to extend obliquely in an upper right direction from a lower side of a downstream end of the inner loading portion 22 in the ejecting direction, and thereafter extend substantially horizontally along the ejecting direction, when viewed along the rotational-axis direction of the ejection pinch roller 39. The document sheet M ejected by the ejection roller units 60 is placed on the inner loading portion 22 and the outer loading portion 23.

Figures 4A, 4B:
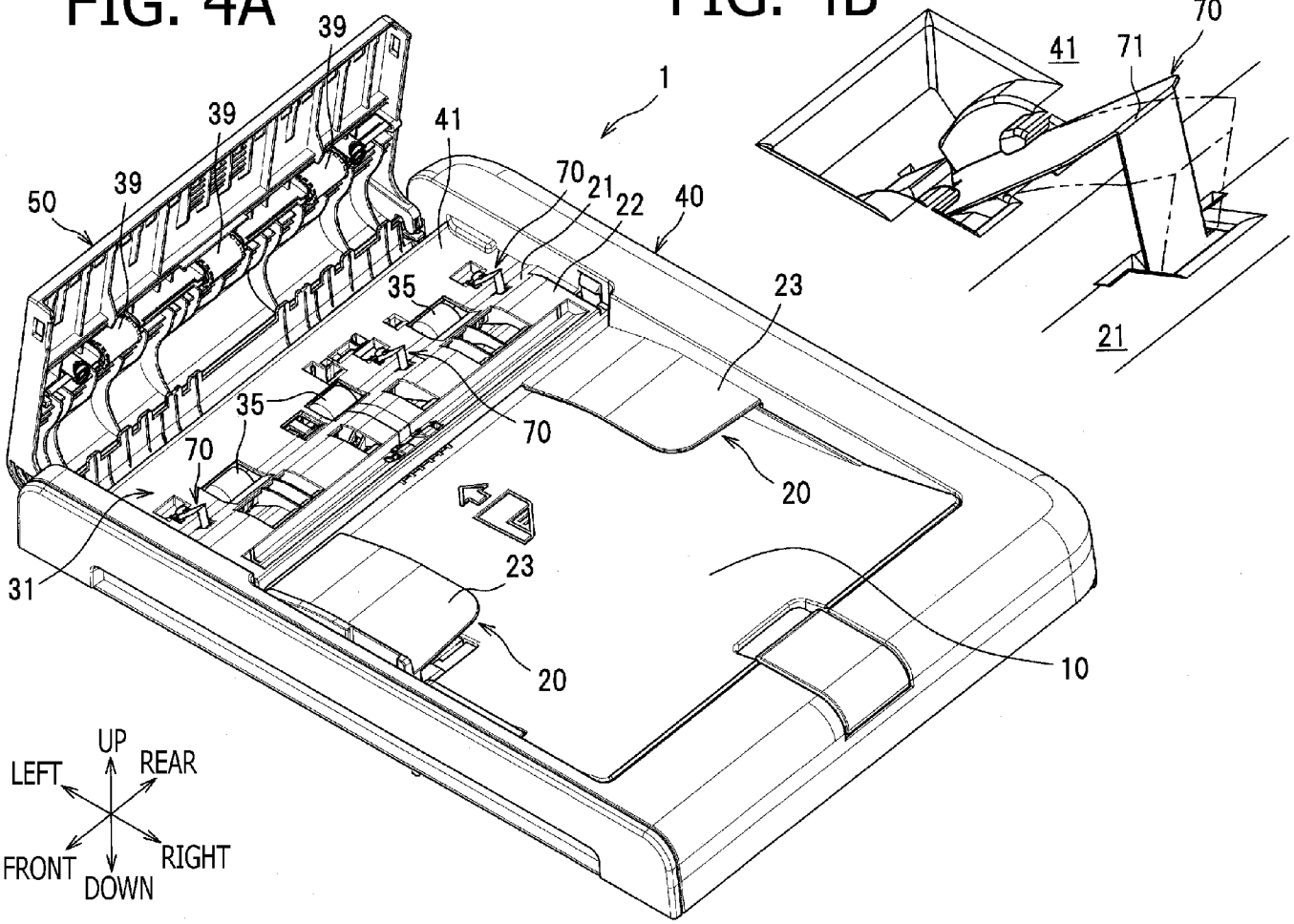
FIG. 4A is a perspective view showing the ADF in a state where a cover is open in the embodiment according to one or more aspects of the present invention.
FIG. 4B is an enlarged perspective view showing a lifting member in the embodiment according to one or more aspects of the present invention.

The cover 50 is configured to form an upper portion of the housing of the document feeding unit 30 and rotatably support the ejection pinch roller 39. The cover 50 is rotatable around a left end thereof with respect to the frame 40. When the cover 50 is closed as shown in FIG. 2, the cover 50 forms an upper wall of the conveyance path 31, and covers the slanted portion 21 and the inner loading portion 22 of the catch tray 20 from above. Further, when the cover 50 is rotated from the closed state to an open state as shown in FIG. 4A, a part (such as an upper face 41 of the frame 40) of the conveyance path 31, the slanted portion 21, and the inner loading portion 22 are exposed to the outside. Thereby, it is possible to easily remove a jammed sheet.

As shown in FIGS. 3 and 4A, there are three ejection roller units 60 arranged along the front-to-rear direction. The first feed roller 35 included in each ejection roller unit 60 is configured to be driven to rotate by a driving force from a driving source such as a motor (not shown). Further, the ejection pinch roller 39 included in each ejection roller unit 60 is disposed above the corresponding first feed roller 35 and configured to be rotated in accordance with the rotation of the corresponding first feed roller 35.

Figures 5A, 5B:
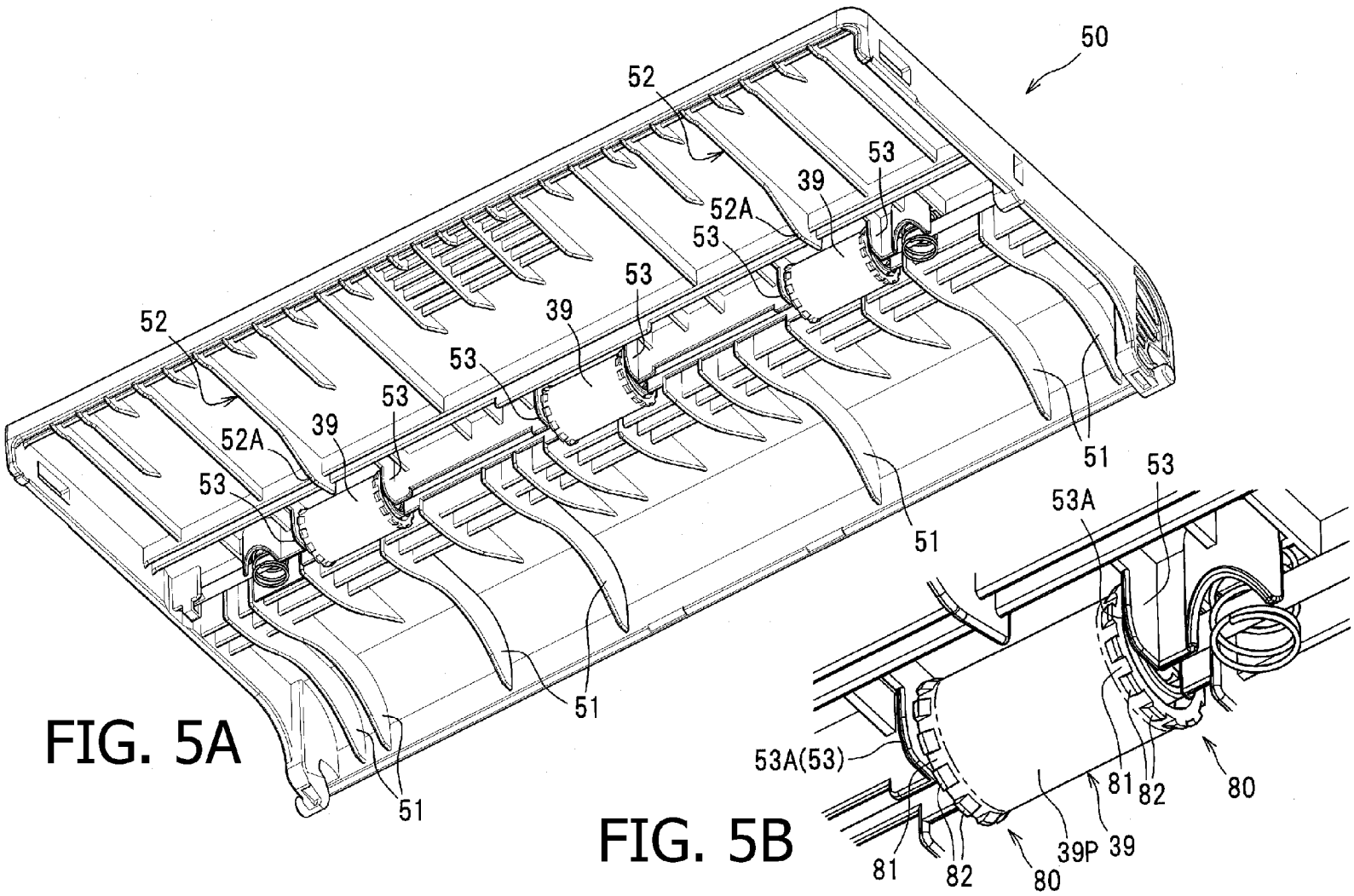
FIG. 5A is a perspective view showing an inner surface side of the cover in the embodiment according to one or more aspects of the present invention.
FIG. 5B is an enlarged perspective view showing the ejection pinch roller in the embodiment according to one or more aspects of the present invention.

As shown in FIG. 5B, there is a pushing section 80 disposed on each side of the ejection pinch roller 39 in the rotational-axis direction. Each pushing section 80 includes a plurality of projections 82 formed on a circumferential surface 81 thereof. The projections 82 are formed to protrude radially outward (i.e., outward in a radial direction of the ejection pinch roller 39) from the circumferential surface 81 of the corresponding pushing section 80. In the embodiment, the pushing sections 80 are formed as a single component integrated with the ejection pinch roller 39. Thus, in the embodiment, as shown in FIG. 3, when the document sheet M is ejected by the ejection roller units 60, the projections 82 of the pushing sections 80, turning integrally with the ejection pinch roller 39, are allowed to push out the document sheet M in the ejecting direction (indicated by a void arrow in FIG. 3) while contacting a trailing end of the document sheet M. It is noted that, in the embodiment, each first feed roller 35 contacts a circumferential surface 39P of the corresponding ejection pinch roller 39 between the two pushing sections 80 formed in the front-to-rear direction.

As shown in FIGS. 3, 4A, and 4B, each lifting member 70 is formed with a flexible film being bent in a V-shape. Each lifting member 70 is configured to protrude toward the cover 50 from the upper face 41 of the frame 40 and the slanted portion 21, such that a bent portion 71 is located at a right side of the lifting member 70 that is a downstream side in the ejecting direction of the ejection pinch roller 39. Although it is not shown in any drawing, an upstream end of the lifting member 70 in the ejecting direction is fixed to the frame 40, and a downstream end of the lifting member 70 in the ejecting direction is a free end not fixed to the frame 40. Thereby, when the document sheet M fed out from the ejection roller units 60 runs on the lifting member 70, the lifting member 70 is elastically pressed down as shown by a dashed line in FIG. 4B.

In the embodiment, there are three lifting members 70 arranged in the front-to-rear direction. More specifically, the three lifting members 70 are respectively disposed in front of the front-most first feed roller 35, behind the rear-most first feed roller 35, and around a center between the rear-most first feed roller 35 and the middle first feed roller 35 in the front-to-rear direction.

Figure 6A:
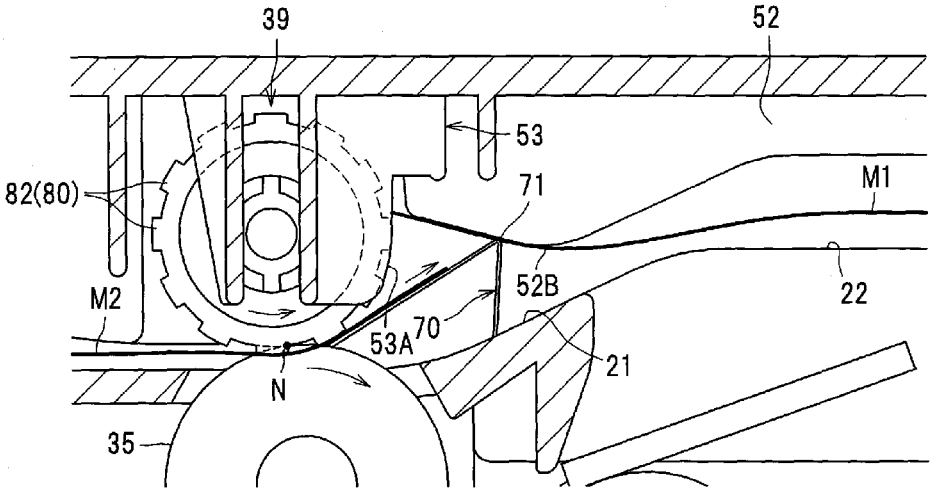
FIG. 6A is an enlarged cross-sectional view, for illustrating operations of the ADF, showing a configuration around the ejection roller unit in the ADF in the embodiment according to one or more aspects of the present invention.

Hereinafter, referring to FIG. 6A, operations for ejecting a document sheet M1 will be described. The document sheet M1 fed out from the ejection roller units 60 is conveyed toward the catch tray 20 while pressing down the lifting member 70, until a trailing end of the document sheet M1 passes through the nipping position N of the ejection roller units 60. Then, after passing through the nipping position N of the ejection roller units 60, the trailing end of the document sheet M1 is pushed out in the ejecting direction by the projections 82 of the pushing sections 80, and thereafter, is lifted higher than the nipping position N by a restring force of the pressed-down lifting member 70 as shown in FIG. 6A. In this situation, when a next document sheet M2 is fed out from the ejection roller units 60, the document sheet M2 is ejected in such a manner that a leading end thereof passes under the trailing end of the document sheet M1 and gets under the document sheet M1. Thus, in the embodiment, the ADF 1 is allowed to eject the document sheet M2 so as to insert the document sheet M2 under the earlier-ejected document sheet M1 placed on the catch tray 20.

As shown in FIG. 5A, on an inner surface of the cover 50, there are a plurality of ribs formed to extend along the ejecting direction. The plurality of ribs include first guide ribs 51, second guide ribs 52, and contact ribs 53.

The first guide ribs 51 are configured to guide, toward the ejection roller units 60, the document sheet M fed substantially upward by the second feed roller 37 and the second pinch roller 38, while curving the document sheet M so as to orient the document sheet M in the ejecting direction. The first guide ribs 51, each extending along the ejecting direction, are arranged in the rotational-axis direction of the ejection pinch roller 39, on an upstream side relative to the ejection pinch roller 39 in the ejecting direction.

The second guide ribs 52 are configured to guide an upward-facing side of the document sheet M ejected from the ejection roller units 60. The second guide ribs 52 are two in total, which are respectively formed on a downstream side in the ejecting direction of the front-most ejection pinch roller 39 and on a downstream side in the ejecting direction of the rear-most ejection pinch roller 39. As shown in FIG. 3, at an upstream end of each second guide rib 52 in the ejecting direction, a mountain-shaped protruding portion 52A is formed to protrude downward. An apical portion 52B, which is the most protruding portion of the protruding portion 52A, is located lower than the bent portion 71 of the lifting member 70 in a state not pressed down, on a downstream side in the ejecting direction relative to the bent portion 71. Thus, as shown in FIG. 6A, the document sheet M1 ejected on the inner loading portion 22 is bent into a state where the trailing end thereof is directed upward, with a position near the apical portion 52B as a fulcrum. Therefore, the trailing end of the document sheet M1 is unlikely to hang down, and the next document sheet M2 is likely to get under the document sheet M1.

As shown in FIGS. 5A and 5B, the contact ribs 53 are configured to protrude downward from the lower surface of the cover 50. The contact ribs 53 are six in total with one contact rib 53 formed on each side of each ejection pinch roller 39 in the rotational-axis direction, so as to be adjacent to the corresponding ejection pinch roller 39. As shown in FIG. 3, each contact rib 53 is disposed to overlap a right-side portion of the ejection pinch roller 39 when viewed along the rotational-axis direction of the ejection pinch roller 39. Each contact rib 53 includes a contact portion 53A formed at a downstream end thereof in the ejecting direction. The contact portion 53A is configured to contact a trailing end of the document sheet M ejected onto the catch tray 20 by the ejection roller units 60.

The contact portion 53A is disposed in such a position as to overlap (coincide with) a most downstream position 80D in the ejecting direction of a rotational trajectory 80T of the pushing sections 80 when viewed along the rotational-axis direction of the ejection pinch roller 39. More specifically, an upper portion of the contact portion 53A relative to the most downstream position 80D extends upward from the most downstream position 80D in a substantially straight manner, and is formed to be located on a downstream side in the ejecting direction relative to a higher portion of the ejection pinch roller 39 than the rotational axis 39A. Meanwhile, a lower portion of the contact portion 53A relative to the most downstream position 80D extends downward substantially in such an arc shape as to overlap (coincide with) the rotational trajectory 80T of the ejection pinch roller 39 when viewed along the rotational-axis direction of the ejection pinch roller 39, up to a lower position (a position side closer to the first feed roller 35) than the rotational axis 39A of the ejection pinch roller 39. More specifically, the lower portion of the contact portion 53A relative to the most downstream position 80D is formed to extend up to a lower position than the highest position (see a line L2 in FIG. 3) of the inner loading portion 22, so as to overlap a part of a lower portion of the ejection pinch roller 39 than the rotational axis 39A when viewed along the rotational-axis direction of the ejection pinch roller 39.

A lower end 53B of the contact rib 53 is located in a position lower than the line L2 shown in FIG. 3, around a center between the rotational axis 39A and the nipping position N in a vertical direction. The contact portion 53A is disposed in such a position that a lower end thereof overlaps (coincides with) the rotational trajectory 80T in a position lower than the rotational axis 39A when viewed along the rotational-axis direction of the ejection pinch roller 39. For instance, an angle θ of a line L1 with respect to a vertical line V (extending in the vertical direction) is within a range of 45 degrees to 60 degrees. The line L1 is a line connecting the rotational axis 39A with an intersection X between the contact portion 53A and the rotational trajectory 80T.

In the embodiment, as shown in FIG. 5A, when the ejection pinch rollers 39 are viewed from a side of the catch tray 20, each second guide rib 52 is disposed to substantially coincide with a center of the corresponding ejection pinch roller 39 in the rotational-axis direction. Further, when viewed from the side of the catch tray 20, there is a contact rib 53 (of the six contact ribs 53) disposed on each side of each ejection pinch roller 39 in the rotational-axis direction.

<Operations and Advantageous Effects of ADF>

Subsequently, explanations will be provided about operations and advantageous effects of the ADF 1, more specifically about operations and advantageous effects of the contact ribs 53, in comparison with a configuration without the contact ribs 53.

Figure 6B:
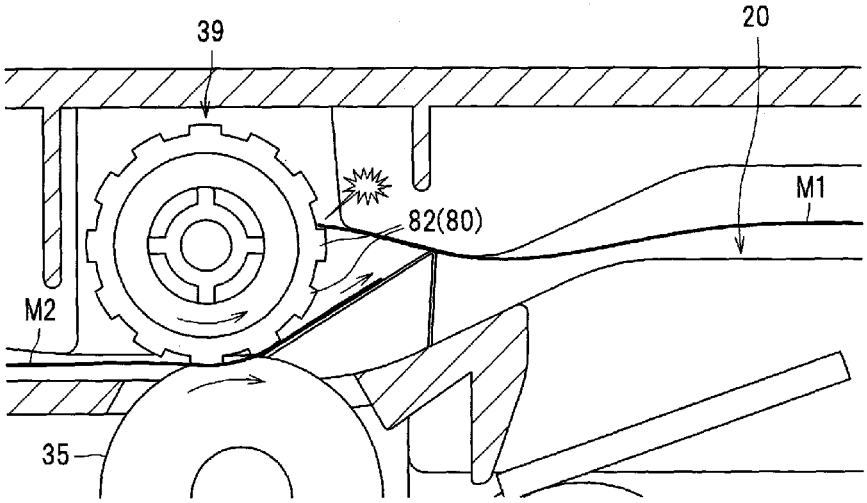
FIG. 6B is an enlarged cross-sectional view showing a configuration around the ejection roller unit in the ADF in a comparative example.

In a configuration without the contact ribs 53, as shown in FIG. 6B as a comparative example, for instance, when the projections 82 of the pushing sections 80 insufficiently push out the trailing end of the document sheet M1, the trailing end of the document sheet M1 ejected on the catch tray 20 may contact the projections 82. When the trailing end of the document sheet M1 ejected on the catch tray 20 contacts the projections 82, the projections 82 are continuously in contact with the trailing end of the document sheet M1 during rotation of the ejection pinch rollers 39. Thus, undesired noises are caused by the projections 82 flipping the trailing end of the document sheet M1.

On the contrary, as shown in FIG. 6A, according to the ADF 1 of the embodiment, for instance, even though the projections 82 of the pushing sections 80 insufficiently push out the trailing end of the document sheet M1, the trailing end of the document sheet M1 ejected on the catch tray 20 contacts the contact portions 53A of the contact ribs 53, and does not contact the projections 82. Thereby, it is possible to prevent undesired noises from being generated by the projections 82 flipping the trailing end of the document sheet M1.

Further, according to the ADF 1 of the embodiment, the contact portion 53A of each contact rib 53 extends up to a position lower than the highest position of the inner loading portion 22. Therefore, for instance, when the document sheet to be fed is so thin that its trailing end is likely to hang down, or a plurality of document sheets are placed on the inner loading portion 22, even though the trailing end of the document sheet is lower than its position shown in FIG. 6A, it is possible to prevent the contact between the trailing end of the document sheet and the projections 82 owing to the contact portions 53A. Thus, according to the ADF 1 of the embodiment, since each contact portion 53A extends up to a position lower than the highest position of the inner loading portion 22, it is possible to prevent the contact between the tailing end of the ejected document sheet and the projections 82. Therefore, it is possible to more effectively prevent undesired noises from being caused by the contact between the tailing end of the ejected document sheet and the projections 82.

When the angle θ shown in FIG. 3 is within a range of 0 degree to about 45 degrees, the projections 82 apply a great pushing force to push the trailing end of the document sheet M. In this case, the trailing end of the ejected document sheet M is unlikely to stay close to the pushing sections 80. Meanwhile, when the angle θ shown in FIG. 3 is in a range more than 45 degrees, the projections 82 apply a small pushing force to push the trailing end of the document sheet M. In this case, the trailing end of the ejected document sheet M is likely to stay close to the pushing sections 80. Thus, when the angle θ of the line L1 (which connects the rotational axis 39A with the intersection X between the contact portion 53A and the rotational trajectory 80T) with respect to the vertical line V (extending in the vertical direction) is set within a range of 45 degrees to 60 degrees, the contact portions 53A are disposed in an angle range (more than 45 degrees) where the projections 82 apply a small pushing force. Further, in this case, the contact portions 53A are not disposed in an angle range (from 0 degree to 45 degrees) where the projections 82 apply a great pushing force. Thereby, in the angle range where the projections 82 apply a great pushing force, it is possible to push out the trailing end of the document sheet M to be ejected, by efficiently utilizing the projections 82. Moreover, in the angle range where the projections 82 apply a small pushing force, it is possible to prevent the contact between the projections 82 and the trailing end of the ejected document sheet M1, and to efficiently prevent undesired noises from being generated due to the contact between the projections 82 and the trailing end of the ejected document sheet M1.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations of the same configurations as exemplified in the aforementioned embodiments will be omitted.

[Modifications]

In the aforementioned embodiment, the contact portion 53A of each contact rib 53 is disposed in such a position as to overlap (coincide with) the most downstream position 80D of the corresponding ejection pinch roller 39 when viewed along the rotational-axis direction of the ejection pinch roller 39. Nonetheless, for instance, referring to FIG. 3, the contact portion 53A of each contact rib 53 may be disposed in a downstream position relative to the most downstream position 80D of the corresponding ejection pinch roller 39 in the ejecting direction when viewed along the rotational-axis direction of the ejection pinch roller 39. Thereby, it is possible to further prevent the contact between the projections 82 and the trailing end of the document sheet ejected on the catch tray 20. Further, even in this case, preferably, each contact rib 53 may be disposed to overlap at least a part of the corresponding ejection pinch roller 39 when viewed along the rotational-axis direction of the ejection pinch roller 39. This is because, when the contact rib 53 is entirely disposed downstream relative to the most downstream position 80D in the ejecting direction, the ejection roller units 60 are required to apply a needlesslygreat feeding force to push out the trailing end of the document sheet up to a downstream position in the ejecting direction relative to the contact portion 53A that is a downstream end of the contact rib 53.

Figure 7:
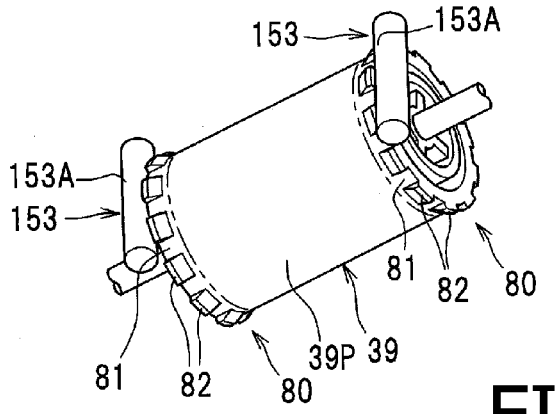
FIG. 7 is a perspective view showing contact members in a modification according to one or more aspects of the present invention.

Further, instead of the rib-shaped contact rib 53 exemplified in the aforementioned embodiment, a contact member 153 having a contact portion 153A as shown in FIG. 7 may be provided. The contact member 153 may be formed in a pin shape protruding from the inner surface of the cover 50 (not shown in FIG. 7). Further, instead of the rib-shaped contact rib 53 exemplified in the aforementioned embodiment, a contact member (not shown) may be provide that is formed in a wall shape extending along the rotational-axis direction of the ejection pinch roller 39.

Figure 8:
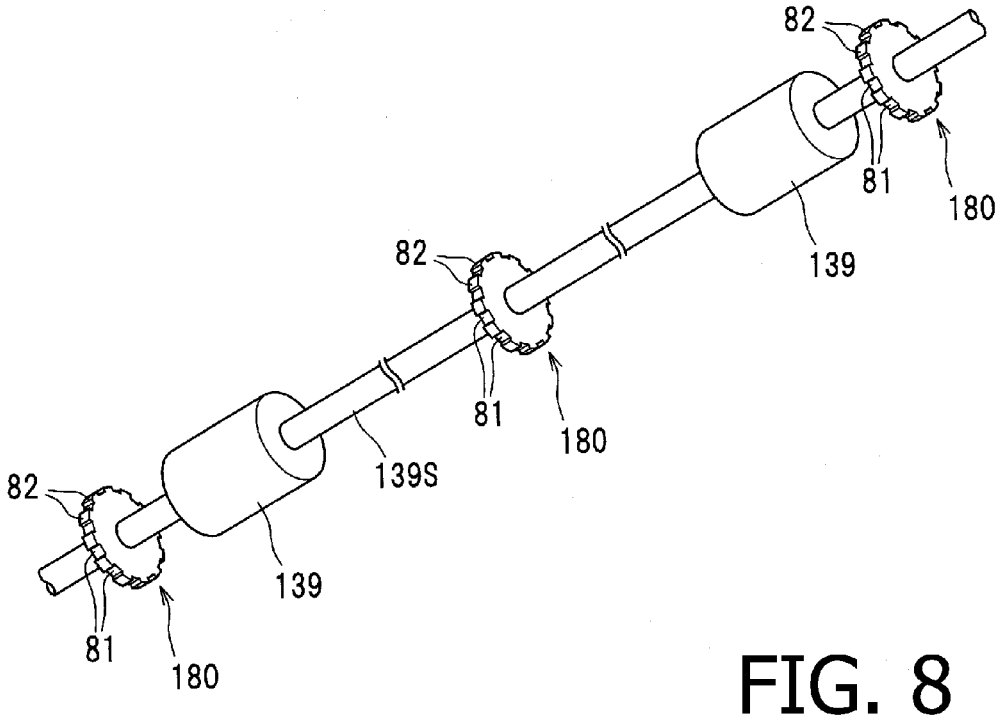
FIG. 8 is a perspective view showing pushing members in a modification according to one or more aspects of the present invention.

In the aforementioned embodiment, the pushing sections 80 are formed integrally with the ejection pinch roller 39. Nonetheless, instead of the pushing sections 80, as shown in FIG. 8, pushing members 180 may be provided as separate components from first rollers 139. More specifically, each pushing member 180 includes a substantially disk-shaped main body, and a plurality of projections 82 formed to radially protrude from a circumferential surface 81 of the main body. Further, each pushing member 180 is supported by a rotational shaft 139S of the first rollers 139 and configured to rotate concentrically and integrally with the first rollers 139. Further, in this configuration, preferably, a contact member (not shown) may be disposed on at least one side of each pushing member 180 in a rotational-axis direction of the first rollers 139, so as to be adjacent to the corresponding pushing member 180. Thereby, it is possible to more efficiently utilize the contact members and more certainly prevent the contact between the projections 82 and the trailing end of the ejected document sheet, than a configuration that each contact member is disposed apart from the pushing members 180.

In the aforementioned embodiment, each ejection roller unit 60 includes two rollers, i.e., the first feed roller 35 and the ejection pinch roller 39. Nonetheless, for instance, each ejection roller unit may include three or more rollers.

In the aforementioned embodiment, exemplified is the ADF 1 configured such that a later-ejected document sheet is inserted under an earlier-ejected document sheet placed on the catch tray 20. Nonetheless, for instance, the ADF 1 may be configured such that a later-ejected document sheet is put onto an earlier-ejected document sheet placed on the catch tray 20.

In the aforementioned embodiment, aspects of the present invention are applied to the ADF 1. Nonetheless, for instance, aspects of the present invention may be applied to a sheet ejecting mechanism, for a printer or a copy machine, which is configured to eject a printed sheet onto a catch tray.

What is claimed is:

1. A sheet ejector comprising:

an ejection roller unit comprising a first roller and a second roller, the first roller disposed above the second roller, the ejection roller unit configured to eject a sheet onto a catch tray in an ejecting direction, wherein the catch tray comprises:

a slanted portion extending obliquely upward from a position close to a nipping position between the first roller and the second roller; and a loading portion extending in the ejecting direction from the slanted portion, the loading portion configured to receive the sheet ejected from the ejection roller unit;

a lifting member configured to lift the trailing end of the sheet ejected on the catch tray, up to a position higher than the nipping position;

a pushing member configured to rotate concentrically with the first roller, the pushing member comprising a projection formed on a circumferential surface of the pushing member, the projection defining an outer circumference; and a contact rib situated adjacent the pushing member and extending in the ejecting direction, the contact rib having a first downstream edge disposed downstream relative to a rotational axis of the first roller in the ejecting direction, the contact rib overlapping the first roller in a view along a rotational-axis direction parallel to the rotational axis of the first roller, wherein the contact rib comprises a first contact portion disposed on a closer side that is closer to the second roller than the rotational axis of the first roller, the first contact portion being a second downstream edge of the contact rib positioned farther downstream in the ejecting direction than the first downstream edge such that the entire contact rib is disposed downstream of the rotational axis of the first roller, wherein the first contact portion extends in the ejecting direction at least to a downstream side of the outer circumference of the projection of the pushing member;

wherein the first contact portion extends up to a position lower than a position of the loading portion; and wherein the first contact portion is disposed, in the view along the rotational-axis direction, in such a position that the first contact portion overlaps the outer circumference of the rotational trajectory of the pushing member, and that a line, connecting the rotational axis with an intersection between the first contact portion and the outer circumference of the rotational trajectory, forms an angle within a range of 45 degrees to 60 degrees with respect to a vertical direction.

2. The sheet ejector according to claim 1, wherein the pushing member is formed integrally with the first roller, and wherein the projection is formed to protrude from the circumferential surface of the pushing member outward in a radial direction of the first roller.

3. The sheet ejector according to claim 1, wherein the contact rib comprises a second contact portion disposed on a farther side that is farther from the second roller than the rotational axis of the first roller; and wherein the second contact portion is disposed, in a view along the rotational-axis direction parallel to the rotational axis of the first roller, in one of:

a position as to overlap the downstream side, in the ejecting direction, of the outer circumference of the rotational trajectory of the pushing member; and a position downstream relative to the downstream side, in the ejecting direction, of the outer circumference of the rotational trajectory of the pushing member.

4. The sheet ejector according to claim 1, further comprising a cover supporting the first roller, wherein the contact rib is formed on the cover and protrudes toward the second roller from the cover.

5. A sheet feeder comprising:

a feed tray;

a catch tray; and a sheet feeding unit configured to feed a sheet from the feed tray toward the catch tray along a conveyance path, the sheet feeding unit comprising:

a pickup roller configured to feed the sheet placed on the feed tray onto the conveyance path;

a separation unit configured to feed the sheet fed from the pickup roller, in a manner separated on a sheet-by-sheet basis;

one or more feed rollers configured to convey the sheet fed from the separation unit, toward the catch tray along the conveyance path;

an ejection roller unit comprising a first roller and a second roller, the first roller disposed above the second roller, the ejection roller unit configured to eject, onto the catch tray in an ejecting direction, the sheet conveyed by the one or more feed rollers, wherein the catch tray comprises:

a slanted portion extending obliquely upward from a position close to a nipping position between the first roller and the second roller; and a loading portion extending in the ejecting direction from the slanted portion, the loading portion configured to receive the sheet ejected from the ejection roller unit;

a lifting member configured to lift the trailing end of the sheet ejected on the catch tray, up to a position higher than the nipping position; and a pushing member configured to rotate concentrically with the first roller, the pushing member comprising a projection formed on a circumferential surface of the pushing member, the projection defining an outer circumference; and a contact rib situated adjacent the pushing member and extending in the ejecting direction, the contact rib having a first downstream edge disposed downstream relative to a rotational axis of the first roller in the ejecting direction, the contact rib overlapping the first roller in a view along a rotational-axis direction parallel to the rotational axis of the first roller, wherein the contact rib comprises a first contact portion disposed on a closer side that is closer to the second roller than the rotational axis of the first roller, the first contact portion being a second downstream edge of the contact rib positioned farther downstream in the ejecting direction than the first downstream edge such that the entire contact rib is disposed downstream of the rotational axis of the first roller, wherein the first contact portion extends in the ejecting direction at least to a downstream side of the outer circumference of the projection of the pushing member;

wherein the first contact portion extends up to a position lower than a position of the loading portion; and wherein the first contact portion is disposed, in the view along the rotational-axis direction, in such a position that the first contact portion overlaps the outer circumference of the rotational trajectory of the pushing member, and that a line, connecting the rotational axis with an intersection between the first contact portion and the outer circumference of the rotational trajectory, forms an angle within a range of 45 degrees to 60 degrees with respect to a vertical direction.

6. The sheet feeder according to claim 5, wherein the pushing member is formed integrally with the first roller, and wherein the projection is formed to protrude from the circumferential surface of the pushing member outward in a radial direction of the first roller.

7. The sheet feeder according to claim 5, further comprising a cover supporting the first roller, wherein the contact rib is formed on the cover and protrudes toward the second roller from the cover.

* * * * *